US005526753A

United States Patent [19]

Morikiyo et al.

[11] Patent Number: 5,526,753

[45] Date of Patent: Jun. 18, 1996

[54] STORAGE APPARATUS FOR A STORAGE CONVEYOR

[75] Inventors: Akira Morikiyo, Tokorozawa; Yoshifumi Sueishi, Hanno; Susumu Kawano, Iruma, all of Japan

[73] Assignee: Tsubakimoto Chain Co., Osaka, Japan

[21] Appl. No.: 491,108

[22] Filed: Jun. 16, 1995

[30] Foreign Application Priority Data

Jun. 20, 1994 [JP] Japan ..... 6-159696

[51] Int. Cl.[6] ..... B61B 13/00

[52] U.S. Cl. ..... 104/162; 104/172.2; 104/252

[58] Field of Search ..... 104/172.1, 172.2, 104/172.3, 249, 250, 252, 253, 88.01, 172.5, 162; 198/803.01

[56] References Cited

U.S. PATENT DOCUMENTS

| | | | |
|---|---|---|---|
| 3,286,652 | 11/1966 | Ringwood et al. | 104/162 |
| 3,877,386 | 4/1975 | Wakabayashi . | |
| 4,348,961 | 9/1982 | Rohrbach | 104/249 X |
| 4,467,725 | 8/1984 | Haldimann | 104/162 |
| 4,638,740 | 1/1987 | Rhodes | 104/172.2 |
| 4,644,869 | 2/1987 | Rhodes | 104/252 X |
| 4,834,607 | 5/1989 | Back | 104/172.2 X |

FOREIGN PATENT DOCUMENTS

| | | | |
|---|---|---|---|
| F16339 | 3/1956 | Germany | 104/172.5 |
| 62-125946 | 6/1987 | Japan . | |

*Primary Examiner*—Lee Young
*Assistant Examiner*—Kevin D. Rutherford
*Attorney, Agent, or Firm*—Armstrong, Westerman, Hattori, McLeland & Naughton

[57] ABSTRACT

The present invention provides a pusher dog, which is mounted on a driving conveyor chain and normally urged to a standing position, and which is detachably hooked on a truck. The pusher dog tilt operation plate is mounted on a storage conveyor. An upward urging member pushes up the pusher dog tilt operation plate to abut a lower end portion of the pusher dog in such a direction that the pusher dog is made to tilt and is released from engagement with the truck. A press down member presses down the pusher dog tilt operation plate against the upward urging force.

2 Claims, 4 Drawing Sheets

STORAGE APPARATUS FOR A STORAGE CONVEYOR

FIELD OF THE INVENTION

The present invention generally relates to storage conveyors and more particularly, to a storage conveyor for conveying end storing goods, which is detachably hooked on a pusher dog, wherein the pusher dog is mounted, at certain intervals, on a driving conveyor chain and normally urged to a stand position.

BACKGROUND OF THE INVENTION

Conventionally, a pusher dog of a storage conveyor, as described in Japanese Patent Publication No. Sho 57-59166, includes a hook portion which is detachably hooked on a truck and an external force action surface which are concentrically formed above a pivotal shaft. According to such a pusher dog, the length of the upper portion of the pusher dog and the turning radius thereof are elongated with respect to the pivotal shaft of the hook portion, with the result that a large amount of space, in a vertical direction between the track of the driving conveyor chain and the running track of the truck which is engaged with the pusher dog, is necessary. However, this raises the problem that the occupied space of the conveyor is increased.

In order to solve the foregoing problem, inherent in the conventional pusher dog, a new and improved pusher dog has been developed. This new and improved pusher dog is disclosed in Japanese Patent Application No. Hei 6-99130. As shown in FIG. 2 and according to the aforementioned Japanese Patent application, the pusher dog D includes only a pusher surface P, formed above the pivotal shaft A, for pushing a pusher dog engaging member B which is vertically elongated downward from the lower surface of the front wheel of the truck, and an external force action surface formed at the lower end portion T of the pusher dog D under the pivotal shaft A.

However, such a pusher dog D, wherein an external force action surface is formed at the lower end portion T thereof, has another problem in that it is difficult to tilt the pusher dog D if using the conventional tilt operation member mounted on the lower surface of the frame of the truck.

SUMMARY OF THE INVENTION

The preferred embodiment of the present invention provides a storage apparatus which includes: a plurality of trucks; a driving conveyor chain; a pusher dog which is detachably hooked on the truck and mounted on the driving conveyor chain and normally urged to a standing position; a storage conveyor for conveying and storing the truck; a pusher dog tilt operation plate mounted on the storage conveyor; an upward urging member for pushing up the pusher dog tilt operation plate to abut a lower end portion of the pusher dog in such a direction that the pusher dog is made to tilt and is released from engagement with the truck; and a press down member for pressing down the pusher dog tilt operation plate against the upward urging force.

Another embodiment of the present invention includes as follows: a storage apparatus comprising a plurality of trucks; a driving conveyer chain; a pusher dog which is detachably hooked on the truck and mounted on the driving conveyer chain and normally urged to a standing position; a storage conveyer for conveying and storing the truck; a pusher dog tilt operation plate mounted on the storage conveyer; an upward urging member for pushing up the pusher dog tilt operation plate to abut a lower end portion of the pusher dog in such a direction that the pusher dog is made to tilt and is released from engagement with the truck; a press down member for pressing down the pusher dog tilt operation plate against the upward urging force; a pusher dog engaging member mounted on the each truck; a control switch for operating the press down member; and an on/off operation plate, mounted on the storage conveyor, for operating the control switch, wherein the on/off operation plate is mounted such that the distance between the pusher dog tilt operation plate and the on/off operation plate is almost the same as the distance between the position of the rear wheel of the leading truck and the position of the pusher dog engaging member of the following truck adjacent to the leading truck and further wherein the on/off operation plate is pushed by the rear wheel of the leading truck.

According to the storage apparatus of the present invention, the storage conveyor endlessly circulates with respect to the elevational plane. When the conveyor chain runs around a driving sprocket and reverses the running direction of the storage conveyor at the front end portion thereof, the storage conveyor goes down and the pusher dog mounted on the chain is released from the pusher clog engaging member, so that the leading truck, at the front end portion of the storage conveyor, stops due to the disconnection with the driving force of the storage conveyor chain.

At this time, the on/off operation plate of the control switch, which can cancel the pressing down operation of the pusher dog tilt operation plate, is upwardly urged at the rear wheel of the leading truck. When the on/off operation plate is pushed down by the rear wheel against the upward urging force, the control switch is on and the lower position maintaining force of the press down member for the pusher dog tilt operation plate is cancelled, with the result that the pusher dog tilt operation plate is lifted.

Because the on/off operation plate is mounted such that the distance between the pusher dog tilt operation plate and the on/off operation plate is almost the same as the distance between the position of the rear wheel of the leading truck and the position of the pusher dog engaging member of the following truck adjacent to the leading truck, when the following truck reaches to the stopping leading truck, the lower end portion of the pusher dog, engaged with the pusher dog engaging member of the following truck and propelling the truck, steps on the lifted pusher dog tilt operation plate so that the pusher dog is tilted and released from engagement with the following truck. In this way, the following truck is made to stop due to the loss of propulsive power, thereby avoiding a collision with the following truck and stopping for storage on the storage conveyor.

Then, the rear wheel of the following truck pushes down the on/off operation plate so that the pusher dog, engaged with the pusher dog engaging plate of the next following truck, is made to be tilted, which, in turn, makes the truck stop so as not to collide with the foregoing truck, and thereafter a plurality of following trucks sequentially can be stopped for storage on the storage conveyor.

In the foregoing case, the pusher dog is released from the leading truck when the running direction of the conveyor chain is reversed. The conveyor chain moves downward at the front end portion thereof so that the truck is made to stop at the front end portion of the storage conveyor. However, in a second case where the leading truck stops in the middle of the storage conveyor before it reaches the front end thereof, a stopper, swingably manipulated, is mounted at the position where the on/off operation plate is disposed in the middle of the storage conveyor. In the second case, a transfer member for switching to the on operation of the control switch, by making the stopper operate to standing position so as to stop the truck, is mounted.

BRIEF DESCRIPTION OF THE DRAWINGS

FIGS. 4(A) and 4(B) are front views of a storage truck disposed on the storage conveyor, a pusher dog operation plate and the on/off operation plate, wherein FIG. 4(A) shows a front view of the storage conveyor at the front end storage position while FIG. 4(B) shows a front view of the storage conveyor at the intermediate storage position.

DETAILED DESCRIPTION OF THE PREFERRED EMBODIMENT

Figure 1:
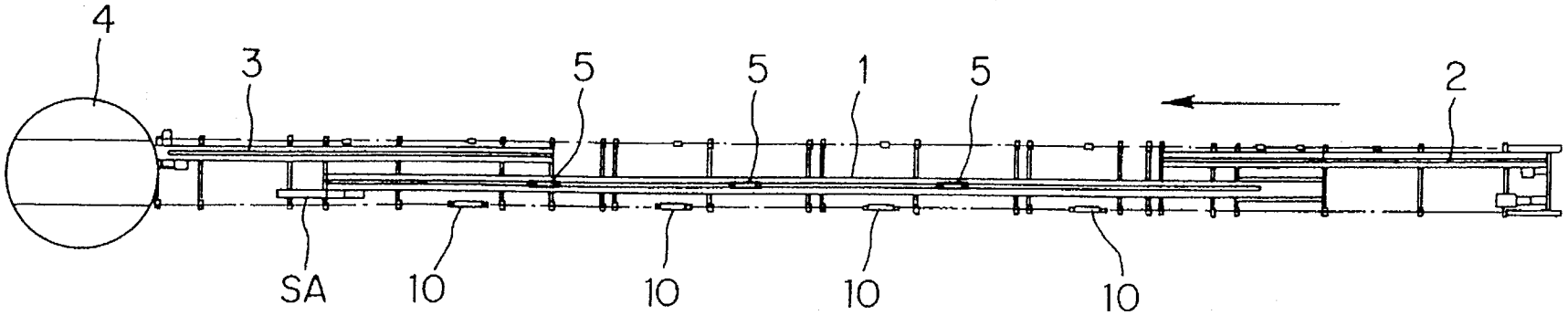
FIG. 1 is a plan view of an embodiment of a storage conveyor of a truck conveyor according to the present invention.

FIG. 1 is a plan view of the preferred embodiment of the storage conveyor of the present invention. A truck (not shown) is brought in by a carrying-in conveyor 2, stored at the storage conveyor 1, where necessary processing is performed, and then sent out, for example, to a turn table 4 by a carrying-out conveyor 3.

Figure 2:
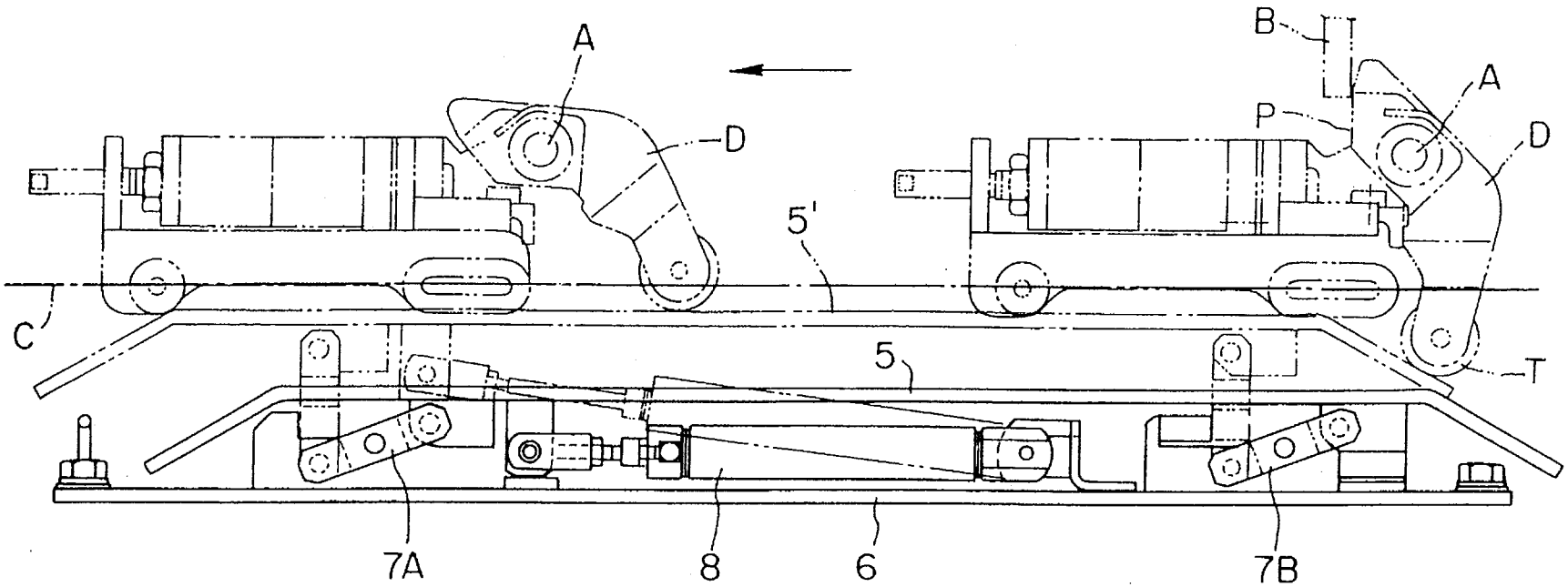
FIG. 2 is an enlarged front view of a pusher dog tilt operation plate.

The present invention relates to the apparatus for putting the truck in storage on the foregoing storage conveyor. This storage conveyor 1, as shown in FIG. 2 which is an enlarged fragmentary view-thereof, includes plural pusher dogs D, swingably mounted to the pivotal shaft A at certain intervals, wherein the pusher dogs D are normally urged to a standing position by driving conveyor chain C endlessly circulating with respect to the elevational plane.

Because the detail of the pusher dog D as shown in the drawing figures has been disclosed in the foregoing Japanese Patent Application No. Hei-99130, the explanation thereof is omitted hereinafter.

At the stop position of the storage conveyor 1, a pusher dog tilt operation plate 5 is mounted along the storage conveyor 1 and supported by a pair of swingable parallel links 7A, 7B at the upper end portion thereof, which is pivotally mounted on the mount member at the lower end portion thereof, wherein the pusher dog tilt operation plate 5 is normally urged by a coil spring (not shown) to an upper position as shown by phantom or dashed lines, A cylinder 8, interconnecting the mount member and the pusher dog tilt operation plate 5, is mounted therebetween with both ends of the cylinder 8 rotatably connected thereto, wherein the cylinder 8 maintains, against the upward urging force, the pusher dog tilt operation plate 5 at the lower position as shown by solid lines.

Figure 3:
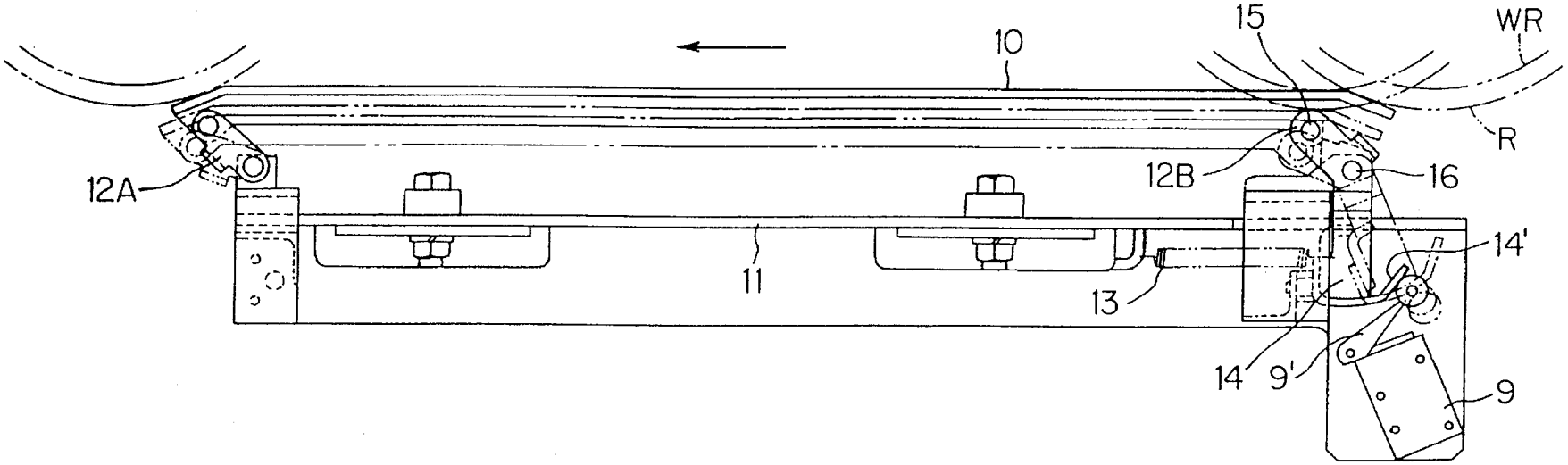
FIG. 3 is an enlarged front view of an on/off operation plate of a control switch.

As shown in FIG. 3, an on/off operation plate 10 for manipulating a control switch 9 is mounted on the mount member 11 by means of a pair of swingable parallel links 12A, 12B, wherein the control switch 9 can cancel the lower position maintaining force through which the pusher dog tilt operation plate 5 can be kept in a lower portion and lift the pusher dog tilt operation plate S through the urging force toward a standing position. An upper end portion of a switch operation rod 14, urged by a coil spring 13 to a standing position, is pivotally mounted on a pin 15 while a central portion of the switch operation rod 14 is pivotally mounted on a pin 1 to which the lower end portion of one link 12B of the pair of parallel links is pivotally connected. Further, a pushing plate 14' for pushing the switch lever 9' of the control switch 9 is mounted at a lower end portion of the switch operation rod 14.

Accordingly, when a rim portion R of the rear wheel WR of the truck rotates in the direction of the arrow such that the on/off operation plate 10, lifted and supported to an upper position (as illustrated by solid lines) by the upper end portion of the switch operation rod 14 which is urged to a standing position by the coil spring 13, is pushed down, against the urging force toward a standing position, to a lower position (illustrated by phantom or dashed lines) the switch operation rod 14 rotates in a clockwise direction, as shown in FIG. 3, that is, from the position illustrated by solid lines to the position illustrated by phantom or dashed lines, and the pushing plate 14', attached to the lower end portion of the switch operation rod 14, rotates in the direction from the position illustrated by solid lines to the position illustrated by phantom or dashed line, thereby turning the control switch 9 off.

The working pressure of the cylinder 8, which keeps the pusher dog tilt operation plate 5 in a lower position, is released by the off-operation of the control switch 9. Then, the upward urging force, urged by the coil spring, lifts up the pusher dog tilt operation plate 5, which loses the lower position maintaining force operated by the cylinder 8, to the position illustrated by phantom or dashed lines in FIG. 2, and tilts the pusher dog D, thereby losing the propulsive power of the truck and stopping the for storage.

Figure 4A:
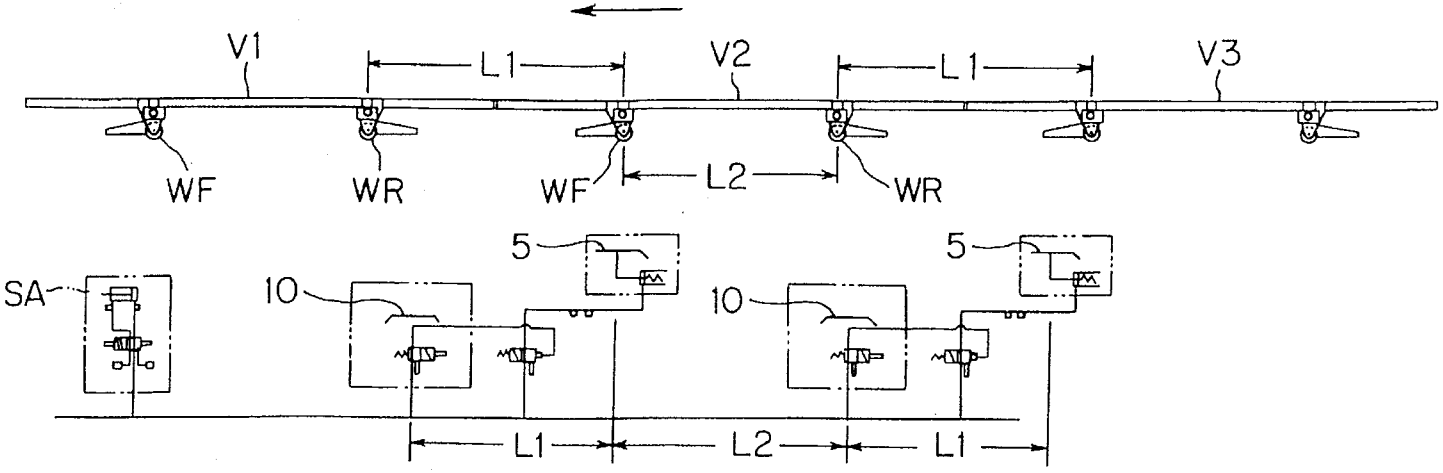
Figure 4B:
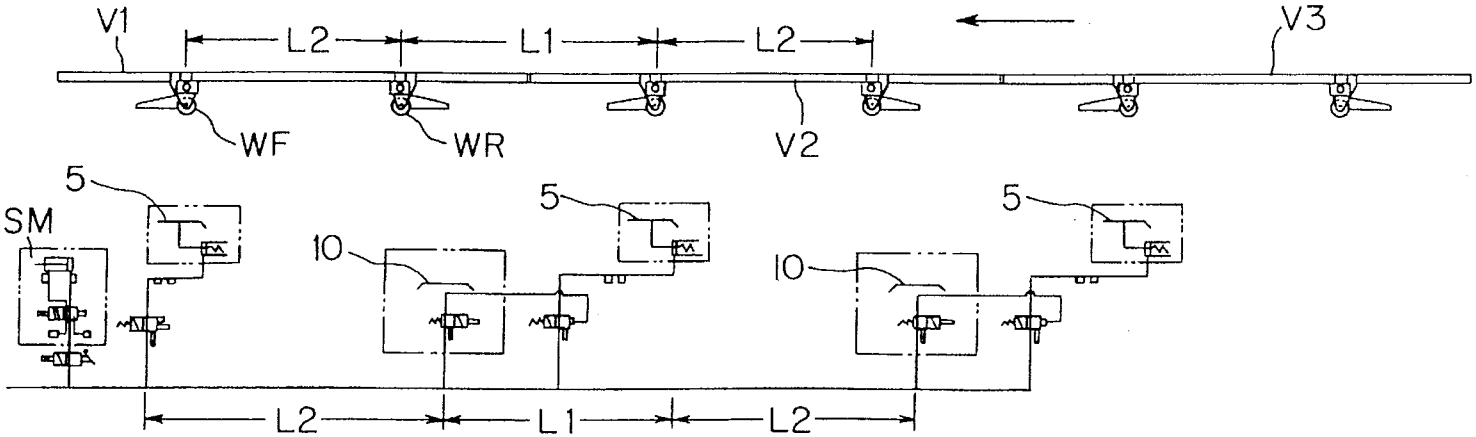

FIG. 4(A) and 4(B) shows an interrelated arrangement diagram of a storage truck disposed on the storage conveyor, a pusher dog operation plate and the on/off operation plate, wherein FIG. 4(A) is an explanatory diagram in which a leading truck V1 stops, followed by following trucks V2, V3, . . . Vn at the front end of the storage conveyor, while FIG. 4(B) is an explanatory diagram in which a leading truck stops, followed by following trucks V2, V3, . . . Vn, at the intermediate position of the storage conveyor.

As described hereinbefore, because the conveyor chain reversed and goes down, the leading truck V1, even if the pusher dog does not tilt, is released from engagement with the truck so that the truck V1 loses its propulsive power and stops. Further, a leading stopper SA for positioning the stop position is mounted, thereby ensuring the automatic stop of the following truck.

In other words, when the front wheel WF of the leading truck V1 stops at the predetermined position, the rear wheel WR steps on the on/off operation plate 10 of the control switch 9, which is made to sink to the position illustrated by phantom or dashed lines so that the control switch is turned off, with the result that the lower position maintaining force of the cylinder 8 (as shown in FIG. 2) is lost and the pusher dog tilt operation plate 5 is lifted to the position illustrated by phantom or dashed lines by the upward urging force. In this way, the pusher dog D, engaged with the pusher dog engaging plate B which is vertically elongated at the front wheel WF of the following truck V2, is made to be tilted so that the truck V2 stops without colliding with the leading truck V1.

The rear wheel WR of the following truck V2 pushes down the on/off operation plate 10 so that the pusher dog D, engaged with the pusher dog engaging plate B of the next following truck V3, is made to be tilted, which, in turn, makes the truck V3 stop without colliding with the foregoing truck V2.

Hereafter, the aforementioned operation is sequentially handed down to the following trucks so that plural following trucks can be stopped for storage on the storage conveyor.

In this case, it is necessary that the distance between the pusher dog tilt operation plate 5 and the on/off operation plate 10 which is disposed ahead of the pusher dog tilt operation plate 5 be almost the same as the distance L1 between the position of the rear wheel WR of the leading truck V1 and that of the pusher dog engaging plate B of the following truck V2 adjacent to the leading truck V1.

The distance between the pusher dog tilt operation plate 5 and the on/off operation plate 10 which is disposed behind the pusher dog tilt operation plate 5 must be, of course, the same as the distance L2 between the position of the pusher dog engaging plate B of the truck and the rear wheel WR of the truck.

When a truck stops for storage at the intermediate position of the storage conveyor, an intermediate position stopper SM is swingably mounted at the intermediate position of the storage conveyor, wherein the motion of the stopper SM to a standing position by means of the external force is related to the off operation of the control switch 9 so that the lower position maintaining force of the cylinder 8 is cancelled, thereby enabling a number of trucks to be stored at the intermediate position thereof udder similar conditions to those shown in FIG. 4(A) or a correlated operation.

Because the truck running rail is made of aluminum drawn material while the chain guide rail is made of steel, bending deformation due to the difference in the coefficient of linear expansion therebetween makes engagement and disengagement between the pusher dog and the truck unreliable and causes malfunctions. For this reason, according to the present invention, a dovetail groove is formed, elongated along the whole length of the side portion of the aluminum rail, to serve as coupling member of the aluminum material and the steel material. That is, a head portion of the bolt is inserted into the dovetail groove, wherein an engagement maintaining sleeve for coupling the aluminum material to the steel material with a distance is fitted around a bolt shaft between the head portion of the bolt and the nut so that a space can be formed in which the aluminum material and the steel material are relatively elastic with respect to each other even though the nut is tightened.

As will be apparent from the foregoing, because the pusher dog tilt operation plate 5 is disposed adjacent to the lower end portion of the pusher dog D which can be abutted by the pusher dog tilt operation plate 5, the pusher dog D can be tilted and stopped on the storage conveyor 1, even though the point of action of the pusher dog tilt operation plate 5 is at the lower end portion of the pusher dog D. Further, because the on/off operation plate 10 is mounted, wherein the distance between the pusher dog tilt operation plate 5 and the on/off operation plate 10 which is disposed ahead of the pusher dog tilt operation plate 5 is almost the same as the distance between the position of the rear wheel WR of the leading truck V1 and that of the pusher dog engaging plate B of the following truck V2 adjacent to the leading truck V1, the on/off operation plate 10 can be pushed down by the rear wheel of the stopping leading truck and the control switch 9 can be switched from "on" to "off" condition, so that the working pressure of the cylinder 8 which keeps the pusher dog tilt operation plate 5 in a lower position is lost. Then, the pusher dog tilt operation plate 5 is lifted so that the pusher dog D of the following truck V2 is tilted. In this way, the next following truck V3 stops without colliding with the leading truck V2. Hereafter, the aforementioned operation is sequentially carried out on the following trucks so that the remaining following trucks can be automatically stopped for storage on the storage conveyor.

Thus, the present invention has the conspicuous advantage that a number of trucks can be sequentially stopped on the storage conveyor without colliding with other trucks, even though the point of action of the tilt operation of the pusher dog is formed at the lower end of the pusher dog.

The terms and expression which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. A storage apparatus, comprising:

a plurality of trucks;

a driving conveyor chain;

a pusher dog mounted on said driving conveyor chain and normally urged to a standing position, said pusher dog being detachably hooked on one of said trucks;

a storage conveyor for conveying and storing said one of said trucks;

a pusher dog tilt operation plate mounted on said storage conveyor;

an upward urging means for pushing up said pusher dog tilt operation plate to abut a lower end portion of said pusher dog in such a direction that said pusher dog is made to tilt and release from the engagement with said truck; and a press down means for pressing down said pusher dog tilt operation plate against the upward urging force.

2. A storage apparatus, comprising;

a plurality of trucks;

a driving conveyor chain;

a pusher dog mounted on said driving conveyor chain and normally urged to a standing position, said pusher dog being detachably hooked on one of said trucks;

a storage conveyor for conveying and storing said one of said trucks;

a pusher dog tilt operation plate mounted on said storage conveyor;

an upward urging means for pushing up said pusher dog tilt operation plate to abut a lower end portion of said pusher dog in such a direction that said pusher dog is made to tilt and release from the engagement with said truck;

a press down means for pressing down said pusher dog tilt operation plate against the upward urging force;

a pusher dog engaging member mounted on each of said one of said trucks;

a control switch for operating said press down means; and an on/off operation plate, mounted on said storage conveyor, for operating said control switch, wherein said on/off operation plate is mounted such that the distance between said pusher dog tilt operation plate and said on/off operation plate is almost the same as the distance between the position of a rear wheel of a leading truck and the position of said pusher dog engaging member of a following truck adjacent to the leading truck and further wherein said on/off operation plate is pushed by the rear wheel of the leading truck.

* * * * *